United States Patent [19]

Alivizatos

[11] Patent Number: 4,607,403

[45] Date of Patent: Aug. 26, 1986

[54] INFANT SUPPORT PADS

[76] Inventor: Margaret A. Alivizatos, 11056 Shady Trail, Suite 113, Dallas, Tex. 75229

[21] Appl. No.: 650,800

[22] Filed: Sep. 14, 1984

[51] Int. Cl.[4] ..... A47C 27/14; A47D 7/00; A61G 7/04

[52] U.S. Cl. ..... 5/449; 5/431; 5/441; 5/455; 5/482

[58] Field of Search ..... 5/450, 465, 449, 450, 5/431, 434, 436, 441, 446, 447, 490, 482; 128/1 B; 297/456

[56] References Cited

U.S. PATENT DOCUMENTS

| | | | |
|---|---|---|---|
| 3,378,861 | 4/1968 | Louseberg | 5/432 |
| 3,459,179 | 8/1969 | Olesen | 5/481 |
| 3,722,012 | 3/1973 | Tobinick et al. | 5/451 |
| 3,840,920 | 10/1974 | Voelker | 5/450 |
| 4,055,866 | 11/1977 | Evans | 5/465 |
| 4,139,920 | 2/1979 | Evans | 5/465 |
| 4,163,297 | 8/1979 | Neumark | 5/446 |
| 4,171,549 | 10/1979 | Morrell et al. | 5/449 |

FOREIGN PATENT DOCUMENTS

| | | | |
|---|---|---|---|
| 934078 | 9/1973 | Canada | 5/450 |
| 2200823 | 7/1973 | Fed. Rep. of Germany | 5/465 |

*Primary Examiner*—Alexander Grosz

*Attorney, Agent, or Firm*—Hubbard, Thurman Turner & Tucker

[57] ABSTRACT

A patient and infant support pad and bolster are each formed of a flexible closed cover of generally rectangular configuration forming a chamber which is filled approximately 50% to 70% of its normal volume with relatively small expanded polystyrene beads. The pad and bolster have unexpected shape conforming qualities and support characteristics which permit the maintenance of several positions for an infant including the semi Fowler's, right lateral, postural drainage, and prone positions while minimizing the prospects of flat head syndrome, or pressure sores.

12 Claims, 8 Drawing Figures

INFANT SUPPORT PADS

BACKGROUND OF THE INVENTION 1. Field of the Invention

The present invention pertains to a support pad and bolster system comprising flexible fabric closed sacks or covers partially filled with expanded polystyrene plastic beads to provide a contoured support surface for distributing support forces substantially evenly over the supported part of an infant's or patient's body.

2. Background

In patient and infant care it is particularly important to be able to support the limbs or the entire body in a comfortable manner with relatively uniform support or pressure exerted over the entire contact surface between the patient and the support structure. For many types of injuries and ailments and, in particular, in the car of premature and full term infants, conventional hospital mattresses and pads are too stiff and provide a support surface which is unyielding and does not adequately conform to the portion of the body in contact wiht the support surface. Accordingly it is difficult to maintain an infant in a predetermined position during rest or treatment and, in the case of physically larger patients, the support may be uneven and produce pressure sores as well as discomfort. In particular, in the support of premature infants, the relative softness of the bone structure, including the skull, can present problems in temporary malformation of bones if the support surface for the infant does not sufficiently conform to the body shape and distribute pressure more evenly than conventional bedding.

Although various types of support pillows and pads are in existence, known types have fill material which provides too firm or an insufficiently conforming shape in response to the weight or pressure applied thereto by the body structure. Moreover, most known types of support pillows or pads must be supplied with slip covers, fabricated of water impermeable material or discarded after becoming soiled or exposed to possibly infectious material. Accordingly, there has been a substantial need for improvements in support pads and similar devices which provide greater flexibility in positioning patients, including premature and full term infants, which provide support for the patient's body or a portion thereof wherein the support forces or pressures are relatively evenly distributed and yet sufficient firmness is provided to maintain the patient in a predetermined position. This need has also included the requirement that the pad be easily washed or sterilized for reuse without losing its shape or support qualities. the present invention provides all of the desiderata mentioned herein as well as other advantages and features which will be apparent to those skilled in the art.

SUMMARY OF THE INVENTION

The present invention provides a patient and infant support pad and bolster which, when used separately or in combination, provide improved support for all or portions of a patient's body including, in particular, improved support for premature and full term infants.

In accordance with one aspect of the present invention there is provided a pad and bolster each characterized by a flexible fabric sack or cover of generally rectangular shape and having a fill material formed of expanded, generally spherical polystyrene or similar type plastic beads which are free to flow within the interior of the sack or cover from one area of the interior to the other to conform to the shape of the patient extremity or body part in contact with the cover. The support pad and bolster each provide for relatively even distribution of supporting pressures exerted on the supported body or part thereof and yet are sufficiently firm to maintain the patient in the supported position.

In accordance with another aspect of the present invention there is provided a combination of flexible fabric support pad partially filled with a quantity of small spherical resilient plastic beads and a bolster for use in combination with the pad comprising a flexible fabric sack or cover encapsulating a quantity of the same bead material as the support pad. The flowability of the fill material and the shape conforming characteristics of the pad and the bolster provide for orienting patients such as premature and full term infants, in particular, in improved positions for various types of treatment.

In accordance with yet a further aspect of the present invention there is provided a patient and infant support pad for controlling the position of a portion of a patient's body or the position of the entire body, in the case of infants and very small children, whereby pressure points on the body are substantially eliminated and the insulating properties of the pad fill material assist in thermal regulation of the patient. The utilization of the pad alone and in combination with a unique bolster is particularly beneficial in treatment and care of infants by eliminating pressure points which, for example, contribute to the flat head syndrome. Moreover, the provision of greater comfort for the infant avoids restlessness and the consequences of same.

In accordance with yet a further aspect of the invention the patient support pad and bolster are filled with nonpermeable spherical plastic beads which do not retain moisture or harbor bacteria, are basically nontoxic and are free of generating dust or particulate matter which could be inhaled or ingested by the infant. The pad and bolster are lightweight, easily cleaned, sufficiently economical to manufacture to be considered a disposable item and easily formed of substantially non-toxic and hypoallergenic materials.

In accordance with yet a further aspect of the present invention, there is provided an improved method of supporting a patient in a variety of new and beneficial positions utilizing an improved support pad and combination in accordance with the present invention.

Those skilled in the art will recognize the above described features and advantages of the present invention as well as additional superior aspects thereof upon reading the detailed description which follows in conjunction with the drawing.

DESCRIPTION OF THE PREFERRED EMBODIMENTS

Figure 1:
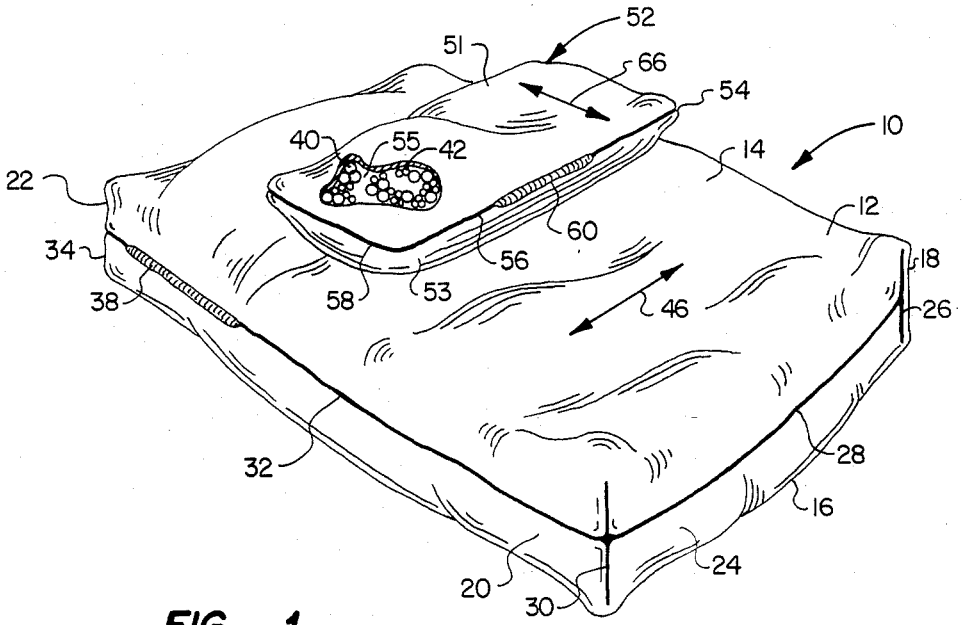
FIG. 1 is a perspective view of the improved patient and infant support pad and bolster in accordance with the present invention.

Referring to FIG. 1, the patient support pad of the present invention is illustrated and generally designated by the numeral 10. The pad 10 comprises a flexible cloth fabric closed sack or cover 12 which is formed to have a generally rectangular shape comprising top and bottom panels 14 and 16, side panels 18 and 20 and end panels 22 and 24 which may be formed from a single piece of fabric cut and sewn along seams 26, 28, 30, 32 and 34 and additional seams, not shown, on the end panel 22 similar to the seams 26 and 28. In this way the cover 12 may be formed from a single piece of fabric sewn together along the seams described and turned inside out to hide the selvage and seam stitching except for a fill slot, generally designated by the numeral 36, FIG. 3. The slot 36 is shown in the closed position and sewn at 38 from the exterior of the cover 12. The pad 10 may be formed of virtually any size; however, in accordance with the invention a size which is particularly suitable for use with premature infants and for supporting patient extremities such as forearms and hands has a length of from 20 inches to 28 inches, a width of 12 inches to 18 inches and height or depth of 2 inches to 4 inches.

In accordance with the invention it has been determined that a particularly advantageous fill material comprises expanded polystyrene plastic beads ranging in size from approximately 0.062 inches to 0.188 inches in diameter, being generally spherical in shape and being formed with a substantially fluid impermeable outer surface.

Figure 3:
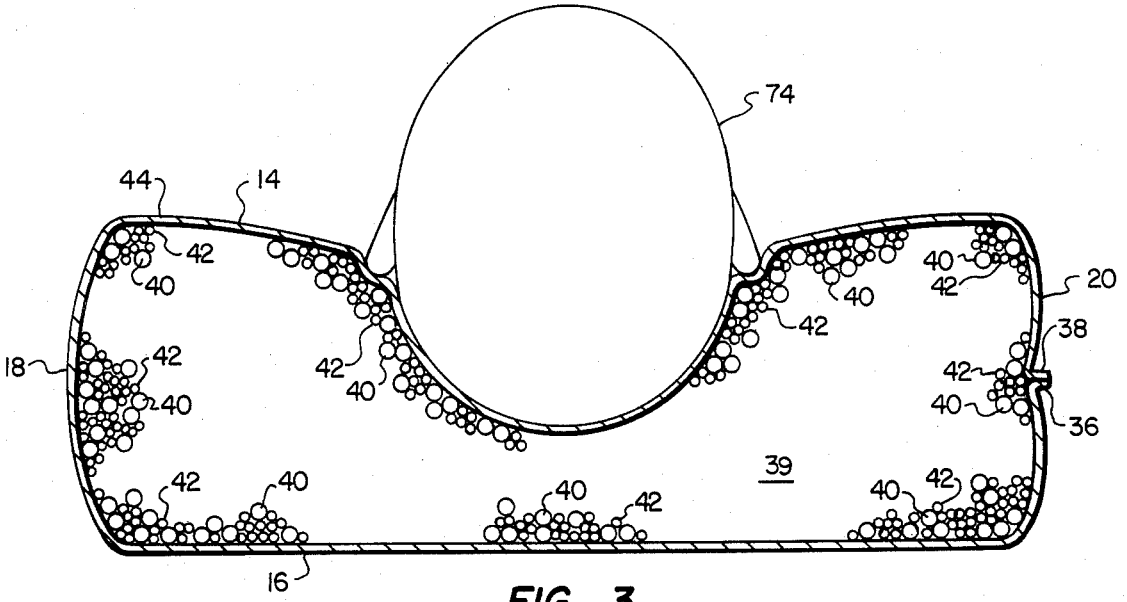
FIG. 3 is a detail section view taken generally along the line 3—3 of FIG. 2.

Referring briefly to FIG. 3, the pad 10 is illustrated in supportive relationship to the head of a patient as will be described further herein and wherein a plurality of expanded polystyrene plastic beads 40, and 42 are illustrated in closely packed contiguous relationship to each other within the interior space 39 of the cover 12 and wherein the beads have undergone substantially free flow to provide uniform support to a patient extremity or to the entire body of the patient.

Referring again to FIGS. 1 and 3, the support cover 12 is preferably formed of a single layer of flexible washable fabric 44 such as terrycloth. The infant support pad and bolster are each of generally rectangular configuration forming a chamber which is filled approximately 50% to 70% of its normal volume with the relatively small expanded polystyrene beads. The fabric 44 used to make the cover 12 is preferably elastically strechable laterally in a direction aligned with the double headed arrow 46, FIG. 1, to facilitate embracement and support of the patient. The cover 12 is preferably filled to about 50% of the maximum volume of the interior chamber 39, FIG. 3, with the plastic beads 40 and 42. The generally rectangular shape of the cover 12 together with the approximately 50% fill of the interior chamber 39 with the beads 40 and 42 allows a sufficient flow of the fill material to present a suitable cavity or depression in the top panel 14 to provide improved support and containment of a portion of a patient's body and, in particular, serve as a support pad or mattress for the entire body of premature as well as full term infants.

Further in accordance with the present invention, there is provided a flexible fabric bolster or pillow, generally designated by the numeral 52, which is preferably formed of the same material as that used for the cover 12. The bolster 52 may be formed of a single piece of terrycloth fabric or the like folded to form an envelope having top and bottom panels 51 and 53, FIG. 1, and sewn along seams 54, 56, and 58 turned reversely to hide the selvage and seam stitching. In FIG. 1 a portion of the panel 51 is broken away to show the interior chamber 55 of the bolster 52 with a sufficient quantity of beads 40 and 42 to occupy approximately 60% to 70% of the interior space formed between the top and bottom panels 51 and 53. A seam portion 60 is suitably closed by stitching after filling the bolster with a quantity of beads 40 and 42. The fabric used in making the bolster 52 also provides for elastic stretch and contraction in the direction of the double headed arrow 66, FIG. 1, that is, laterally relative to the overall length of the bolster. The overall dimensions of the bolster 52 for use with a pad 10 according to the above mentioned dimensions would be approximately 8 inches length by 4.5 inches width and filled with beads 40 and 42 so as to have a maximum thickness at the center of approximately 1.0 inches to 1.5 inches.

Figure 2:
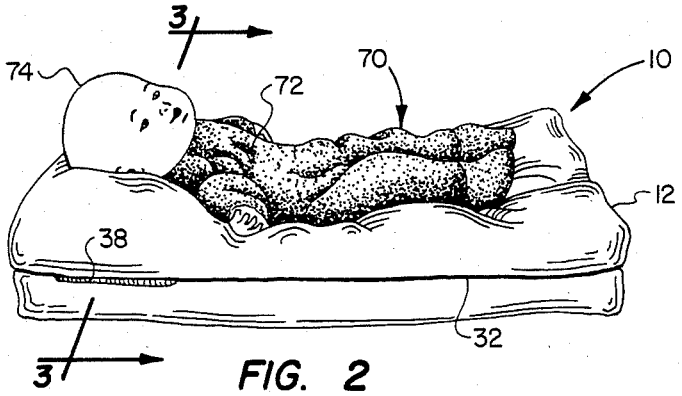
FIG. 2 is a side view of an infant supported on the support pad in s semi Fowler's position.

Referring now to FIGS. 2 and 3, the pad 10 is shown in use supporting an infant person, generally designated by the numeral 70, wherein the pad has been to some extent premolded to receive the infant's torso 72 and head 74 in substantial embracement and supportive relationship thereto. The position illustrated in FIG. 2, also known as the semi Fowler's position, provides for the torso or trunk 72 to be slightly elevated. This position is substantially impossible to maintain safely with conventional support means such a relatively stiff mattress or the like during treatment of respiratory distress syndrome, bronchopulmonary dysplasia, diaphragmatic hernia, congestive heart failure, pneumothorax and gastric reflux.

Figure 4:
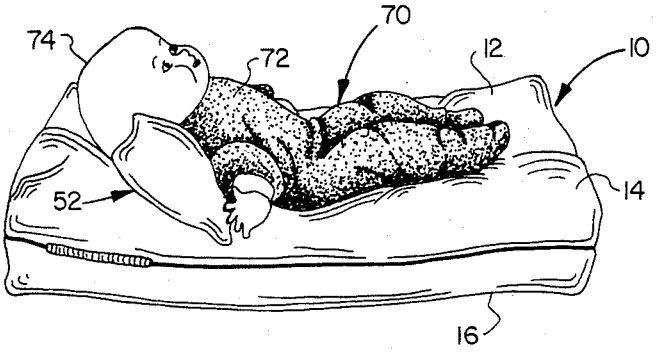
FIG. 4 is a side view of an infant supported in the semi Fowler's position with neck hyperextension utilizing the support pad and bolster of the present invention.

Referring now to FIG. 4, a second beneficial position is illustrated with the use of the bolster 52 placed behind the infant's head 74 so as to hyperextend the neck. This is a particularly valuable position when a mask or nasal CPAP is being used. Moreover, babies with tracheostomies are also particularly benefited when placed in this position. This position also offers an alternative to the prone and right lateral positions after feeding since it facilitates gastric emptying.

The premolding and formation of supportive depressions in the pad 10 are particularly facilitated by the easy rolling action of the spherical plastic beads 40 and 42 and wherein the beads easily flow to fill any gaps and conform substantially to the shape and contour of the patient's body. In this regard various other positions such as left or right lateral positions are very easily maintained by the provision of support both along the front and back of the patient. This makes rolling of the patient, particularly infants, much less likely and thereby reduces the risk of aspiration while facilitating gastric emptying.

Figure 5:
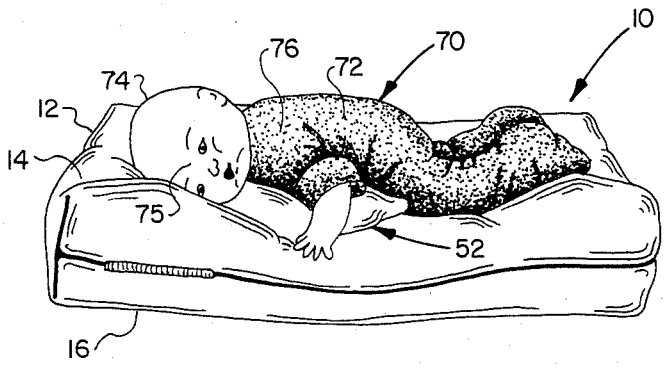
FIG. 5 is a side view of an infant supported in the prone position with the bolster supporting the chest and shoulders to leave the face free.

Referring now to FIG. 5, the infant 70 is shown in a prone position with the bolster under 52 extending lengthwise somewhat across the torso 72 under the shoulders 76. This position is particularly comfortable thereby reducing restlessness and eliminating the tendency to have sore knees. This position is also the position of choice for continuous or intermittent tube feeding of infants and leaves the face free for easy breathing.

Figure 6:
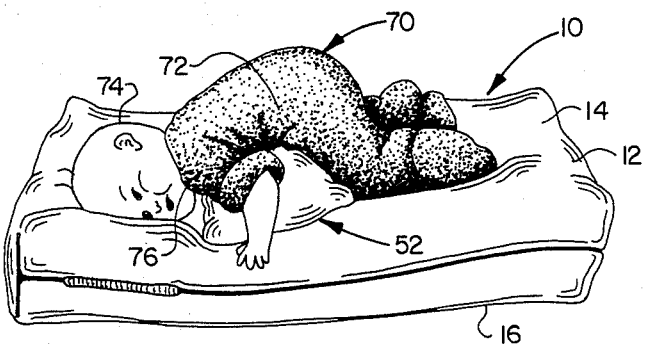
FIG. 6 is a side view of an infant supported in a prone position with utilization of the bolster to facilitate postural drainage.

Referring briefly to FIG. 6, the pad 10 and the bolster 52 are shown in supportive relationship to the infant 70 with the bolster extending lengthwise across the torso 72 and disposed below the shoulders 76 and, despite the ease of conforming capability of the pad 10 and the bolster 52, both devices are sufficiently firm as to maintain an effective drainage position during chest physiotherapy.

Figure 7:
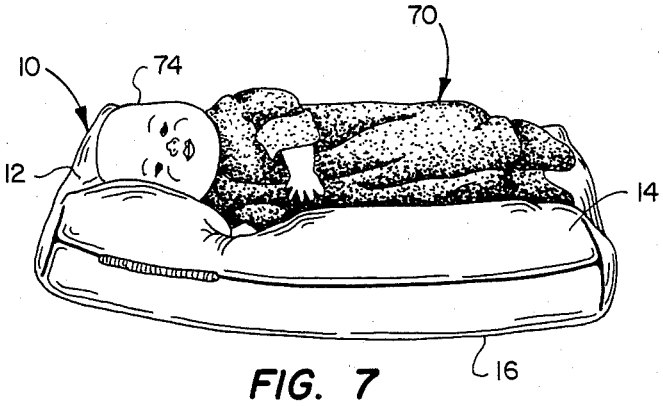
FIG. 7 is a side view of an infant supported in the right lateral position.

Referring to FIG. 7, the infant 70 is illustrated, by way of example, resting in the right lateral position on the pad 10 without the use of the bolster 52. Thanks to the conforming qualities of the pad, the head 74 may be maintained in a sideways position as well as the rest of the infant's body to prevent the infant from rolling either onto its back or stomach and thereby making the risk of aspiration much less likely. The use of one or more bolsters 52, not shown in FIG. 7, along the front or back side of the patient's body may also assist in maintaining a right or left lateral position.

Figure 8:
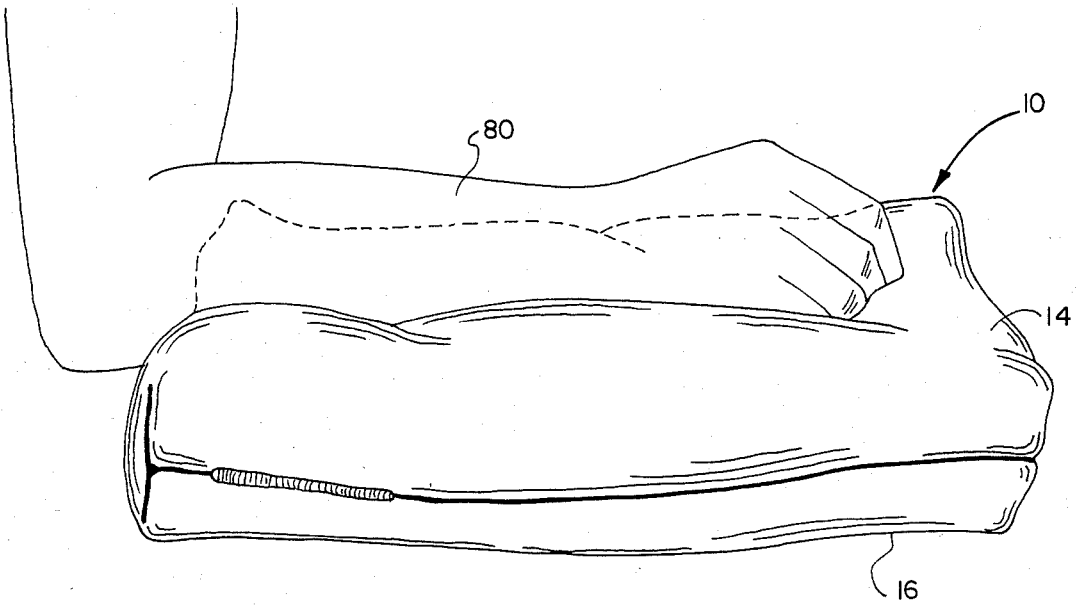
FIG. 8 is a perspective view of the support pad being utilized to support the arm of an adult patient.

Referring now to FIG. 8, the pad 10 is shown in use with a forearm 80 of an adult patient in supportive relationship thereto wherein the pad 10 easily conforms to the shape of the forearm and provides substantial support over a major portion of the periphery of the arm to more evenly distribute stress and strain and produce a somewhat floating sensation to the patient. Although premolding of the pad 10 may facilitate the support offered by the pad in some positions of the patient, it will be understood that in most cases the free flow characteristics of the fill material will permit use of the pad 10 and bolster 52 by merely placing the portion of the body, or all of the body in use with infants, on the pad without requiring any preliminary shaping effort.

Those skilled in the art will appreciate from the foregoing description of the pad 10 and the bolster 52, together with the description of the methods for supporting infants and portions of patients'bodies in conventional and new positions, that a particularly comfortable support means is provided which is beneficial for unconscious patients with no voluntary muscle tone and, when used under the neck, for example, allows relatively safe and comfortable support under hyperextension. It will also be appreciated that the pad 10 and the bolster 52, together or separately, may be used to support body portions which have bony prominances while reducing the risk of the formation of pressure sores.

The pad 10 and the bolster 52 are particularly adapted to utilize the insulating properties of polystyrene plastic which greatly assists in infant thermoregulation and offering the infant a feeling of warmth and security similar to that of the intrauteral environment. The use of the spherical polystyrene beads or spheres 40 and 42 provides a nonpermeable fill material which will not retain moisture or harbor bacteria and is particularly advantageous as compared with the use of shredded or open cell plastic materials. Although the pad 10 and the bolster 52 may be considered as disposable items, they are safely machine washable and may be used over substantial periods of time without losing shape or support characteristics.

Although preferred embodiments of the present invention have been described herein in detail those skilled in the art will recognize that various substitutions and modifications may be made to the specific structures and methods of use described without departing from the scope and spirit of the invention recited in the appended claims.

What I claim is:

1. An infant support pad for supporting infants which lack voluntary muscle tone, comprising:

a single infant sized three dimensional rectangular flexible fabric cover comprising top, bottom, side and end panels, forming a closed interior chamber, said chamber being partially filled from about 50% to about 70% of its maximum volume with generally spherical resilient plastic beads formed from expanded cellular plastic expanded to a diameter in the range of about 0.062 inches to 0.188 inches, to form substantially liquid impermeable fill for said pad and to provide a firm yet yieldable support surface which conforms to the contour of the infants body to distribute support forces uniformly thereover.

2. The support pad set forth in claim 1 wherein:

said cover has dimensions in the range of about 20 inches to 28 inches length by 12 inches to 18 inches width by 2 inches to 4 inches depth.

3. The support pad set forth in claim 1 wherein:

said cover is formed of a fabric which is elastically stretchable in lateral directions.

4. The support pad set forth in claim 3 wherein:

said cover is formed of terrycloth.

5. A combination support pad and bolster for supporting an infant in a selected one of plural positions comprising a semi Fowler's position, a prone position, or a postural drainage position, comprising:

a single infant sized three dimensional rectangular flexible fabric cover comprising top, bottom, side and end panels, forming a closed interior chamber, said chamber being partially filled from about 50% to about 70% of its maximum volume with generally spherical resilient plastic beads formed from expanded cellular plastic expanded to a diameter in the range of about 0.062 inches to 0.188 inches, to form substantially liquid impermeable fill for said pad and to provide a firm yet yieldable support surface which conforms to the contour of the infant's body to distribute support forces uniformly thereover; and said bolster comprising a generally rectangular flexible fabric envelope forming a closed interior chamber at least partially filled with said beads, said bolster having a nominal length about the same as the nominal width of said pad and a maximum thickness of about 1.0 inches to 1.5 inches.

6. The combination set forth in claim 5 wherein:

said cover is formed of a woven fabric which is elastically stretchable in lateral directions.

7. The combination set forth in claim 6 wherein:

said envelope is formed of a woven fabric which is elastically stretchable in at least one direction.

8. A method for supporting an infant in a semi Fowler's position comprising the steps of:

providing a support pad comprising a single infant size three dimensional rectangular flexible fabric cover comprising top, bottom, side and end panels forming a closed interior chamber, said chamber being partially filled from about 50% to about 70% of its maximum volume with generally spherical resilient plastic beads formed from expanded cellular plastic expanded to a diameter in the range of about 0.062 inches to 0.188 inches to form substantially liquid impermeable fill for said pad and to provide a firm yet yieldable support surface which conforms to the contour of the infant's body to distribute support forces uniformly thereover;

providing a recess in said pad by displacing said beads into a distributed position whereby said pad firmly supports said infant in said position for minor muscular activity without restraint; and placing said infant in said position to be supported solely by said support pad.

9. The method set forth in claim 8 including the steps of:

hyperextending the neck of said infant by providing a bolster comprising a generally rectangular flexible fabric envelope forming a closed interior chamber, said chamber being partially filled with generally spherical resilient plastic beads formed from expanded cellular plastic to form substantially liquid impermeable fill for said envelope and to provide a firm yet yieldable support surface which conforms to the contour of the infant's body to distribute support forces uniformly thereover.

10. A method for supporting an infant in a prone position with the face free comprising the steps of:

providing a support pad comprising a single infant sized three dimensional rectangular flexible fabric cover having top, bottom, side and end panels with nominal dimensions of about 20 inches to 28 inches length, 12 inches to 18 inches width and 2 inches to 4 inches depth and forming a closed interior chamber, said chamber being partially filled from about 50% to about 70% of its maximum volume with generally spherical resilient plastic beads formed from expanded cellular plastic expanded to a diameter in the range of about 0.062 inches to 0.188 inches to form substantially liquid impermeable fill for said pad and to provide a firm yet yieldable support surface which conforms to the contour of the infant's body to distribute support forces uniformly thereover;

molding a recess in said pad by displacing said beads into a distributed position whereby said pad firmly supports said infant in said position for minor muscular activity without restraint;

providing a bolster comprising a generally rectangular flexible fabric envelope at least partially filled with generally spherical resilient plastic beads to provide a firm yet yieldable support surface, said bolster having a length about equal to the width of said pad, a width of about 4 inches to 5 inches and a thickness of about 1.0 inches to 1.5 inches; and placing said bolster under said infant's shoulders with said infant supported on said pad in a prone position to permit the face to be free and to reduce pressure on the infant's knees.

11. A method for supporting an infant in a substantially prone position with the face free comprising the steps of:

providing a support pad comprising a single infant sized three dimensional rectangular flexible fabric cover having top, bottom, side and end panels with nominal dimensions of about 20 inches to 28 inches length, 12 inches to 18 inches width and 2 inches to 4 inches depth and forming a closed interior chamber, said chamber being partially filled from about 50% to about 70% of its maximum volume with generally spherical resilient plastic beads formed from expanded cellular plastic expanded to a diameter in the range of about 0.062 inches to 0.188 inches to form substantially liquid impermeable fill for said pad and to provide a firm yet yieldable support surface which conforms to the contour of the infant's body to distribute support forces uniformly thereover;

molding a recess in said pad by displacing said beads into a distributed position whereby said pad firmly supports said infant in said position for minor muscular activity without restraint;

providing a bolster comprising a rectangular flexible fabric envelope at least partially filled with generally spherical resilient plastic beads to provide a firm yet yieldable support surface, said bolster having a length about equal to the width of said pad, a width of about 4 inches to 5 inches and a thickness of about 1.0 inches to 1.5 inches; and placing said bolster under said infant's chest with said infant supported on said pad in a prone position to permit the face to be free, and to reduce pressure on the infant's knees, and to facilitate postural drainage.

12. A method for supporting an infant in a lateral position with the face free comprising the steps of:

providing a support pad comprising a single infant sized three dimensional rectangular flexible fabric cover having top, bottom, side and end panels with nominal dimensions of about 20 inches to 28 inches length, 12 inches to 18 inches width and 2 inches to 4 inches depth and forming a closed interior chamber, said chamber being partially filled from about 50% to about 70% of its maximum volume with generally spherical resilient plastic beads formed from expanded cellular plastic expanded to a diameter in the range of about 0.062 inches to 0.188 inches to form substantially liquid impermeable fill for said pad and to provide a firm yet yieldable support surface which conforms to the contour of the infant's body to distribute support forces uniformly thereover;

forming a longitudinally extending recess in said pad by displacing said beads into a distributed position whereby said pad firmly supports said infant in said position for minor muscular activity without restraint but preventing said infant from rolling into a supine or prone position; and placing said infant in said lateral position to be supported by said support pad.

* * * * *